US005632311A

United States Patent [19]

Raaschou

[11] Patent Number: 5,632,311

[45] Date of Patent: May 27, 1997

[54] FENCE REPAIRING TOOL FOR WIRE FENCES

[76] Inventor: George Raaschou, Box 381
Mayerthorpe, Alberta, Canada, T0E 1N0

[21] Appl. No.: 488,737

[22] Filed: Jun. 8, 1995

[30] Foreign Application Priority Data

Jun. 21, 1994 [CA] Canada ..... 2126432

[51] Int. Cl.[6] ..... B21F 9/00

[52] U.S. Cl. ..... 140/118; 74/547

[58] Field of Search ..... 140/117, 118, 140/119; 74/547

[56] References Cited

U.S. PATENT DOCUMENTS 503,747 8/1893 Latin ..... 74/547
1,715,902 6/1929 Countryman ..... 74/547
2,124,416 7/1938 Hadland ..... 140/123.5
5,080,145 1/1992 Groover ..... 140/118

*Primary Examiner*—Lowell A. Larson
*Attorney, Agent, or Firm*—Anthony R. Lambert

[57] ABSTRACT

A fence repairing tool for wire fences is described which includes an elongate wire retaining member. The wire retaining member has an exterior surface and a transverse passage. An end of a wire is inserted into the transverse passage and the wire retaining member rotated to wrap wire around the exterior surface of the wire retaining member. A crank is provided having a handle and a shaft. The shaft is secured at an angle to the wire retaining member, such that the wire retaining member is rotated by manipulating the handle of the crank.

1 Claim, 3 Drawing Sheets

FENCE REPAIRING TOOL FOR WIRE FENCES

FIELD OF THE INVENTION

The present invention relates to a fence repairing tool for wire fences.

BACKGROUND OF THE INVENTION

It is possible to repair a wire fence using a hammer and a short piece of repair wire. Firstly, if not already severed, the wire is cut leaving a first end and a second end. Secondly, the first end and the second end are formed into loops. Thirdly, the repair wire is interlocked with the first loop by forming a first end of the repair wire into a loop. Fourthly, a second end of the repair wire is threaded through the second loop and then wrapped around a head of the hammer. The repair wire is then slowly wrapped around the head of the hammer to pull the wire fence back into an upright position. The repair wire is pulled 180 degrees back onto itself and then unwound from the head of the hammer. The second end of the repair wire is then wrapped around itself to form the second end into a tight loop which will maintain the wire fence in position.

The problem with using a hammer with this repair method, is that a hammer is not suited for the job. There is a danger the repair wire will slip on the head of the hammer resulting in injury to the farmer. Normally it is the hands of the farmer that gets punctured by one of the barbs from the wire.

SUMMARY OF THE INVENTION

What is required is a fence repairing tool better suited for use in repairing wire fences.

According to the present invention there is provided a fence repairing tool for wire fences which includes an elongate wire retaining member. The wire retaining member has an exterior surface and a transverse passage. An end of a wire is inserted into the transverse passage and the wire retaining member rotated to wrap wire around the exterior surface of the wire retaining member. A crank is provided having a handle and a shaft. The shaft is secured at an angle to the wire retaining member, such that the wire retaining member is rotated by manipulating the handle of the crank.

Although beneficial results may be obtained through the use of the fence repairing tool, as described above, it is desirable that the tool take up a minimum of space. A farmer wants to be able to put the tool into his pocket, if he is walking along the fence line inspecting the condition of the fence. He wants to be able to place the tool in his saddle bags, if he is inspecting the fence while on horseback. He wants to be able to place the tool in his tool box, if he is inspecting the fence from his vehicle. Even more beneficial results may, therefore, be obtained if the wire retaining member, the handle or, preferably, both can be folded to make the fence repairing tool more compact. The handle is pivotally connected the shaft and is pivotally movable between a stored position substantially parallel to the shaft and an operative position substantially perpendicular to the shaft. The wire retaining member is pivotally connected the shaft and is pivotally movable between a stored position substantially parallel to the shaft and an operative position substantially perpendicular to the shaft.

Although beneficial results may be obtained through the use of the fence repairing tool, as described above, it is highly desirable that the wire retaining member and the handle be locked in the operative position. Even more beneficial results may, therefore be obtained when the wire retaining member and the handle each have a transverse locking aperture adjacent the pivotal connection with the shaft. A biasing spring is wrapped around the shaft of the crank. A collar which telescopically receives the shaft is positioned at each end of the biasing spring. Each collar has a locking member projecting axially away from the biasing spring. The locking members extends into the locking apertures of the wire retaining member and the handle when they are in the operative position, thereby locking the wire retaining member and the handle in their respective operative positions.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
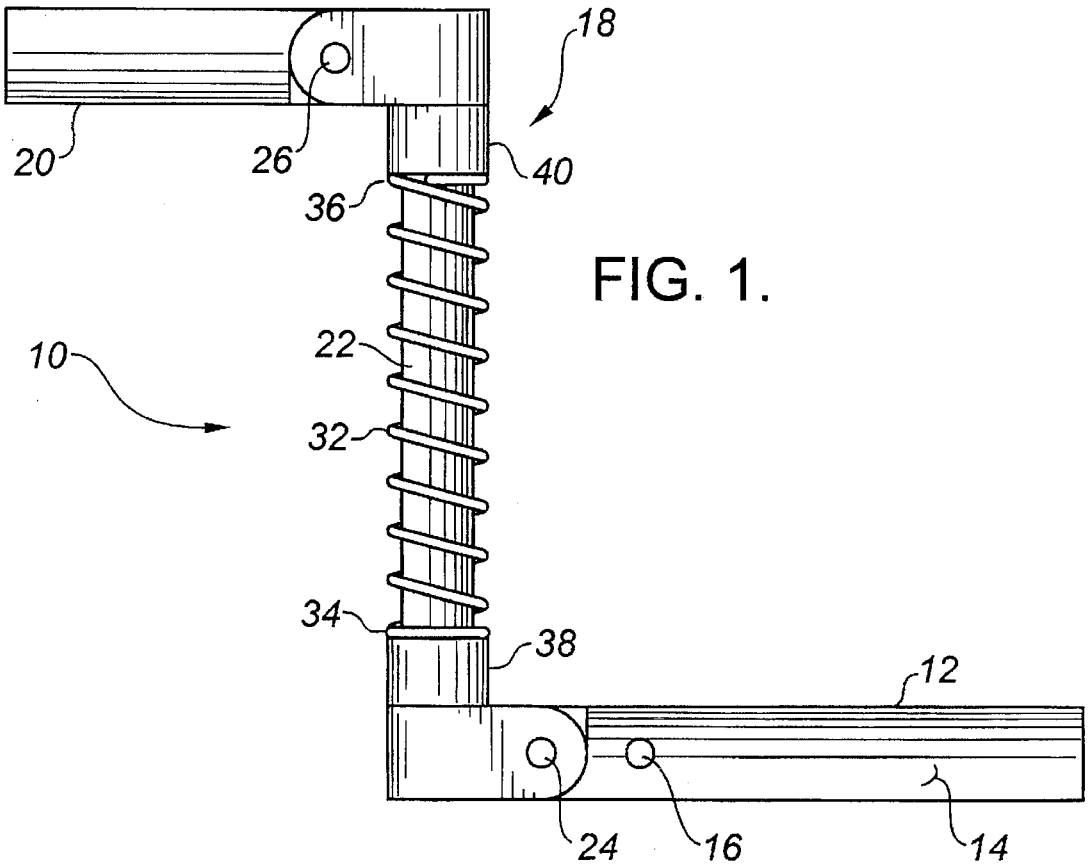
FIG. 1 is a fence repairing tool constructed in accordance with the teachings of the present invention, in an operative position.

The preferred embodiment, a fence repairing tool for wire fences generally identified by reference numeral 10, will now be described with reference to FIGS. 1 through 5.

Figure 2:
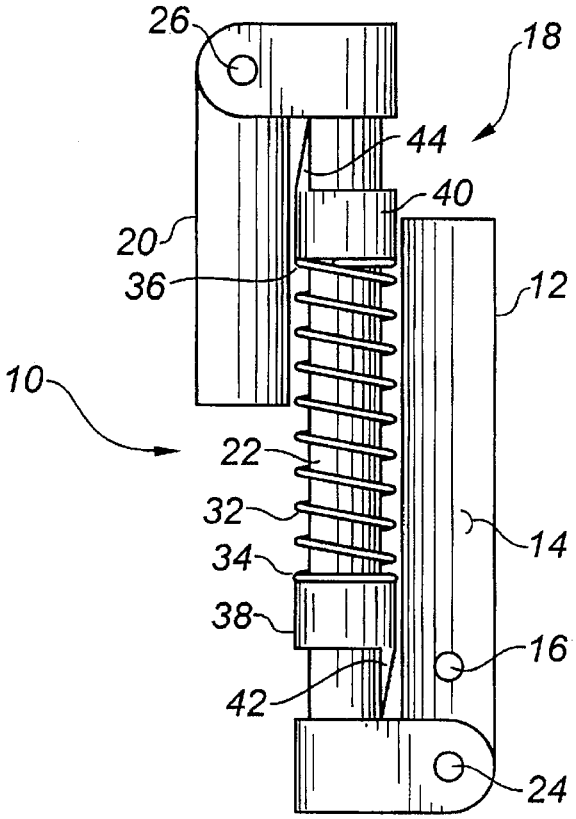
FIG. 2 is the fence repairing tool illustrated in FIG. 1, in a stored position.
Figure 3:
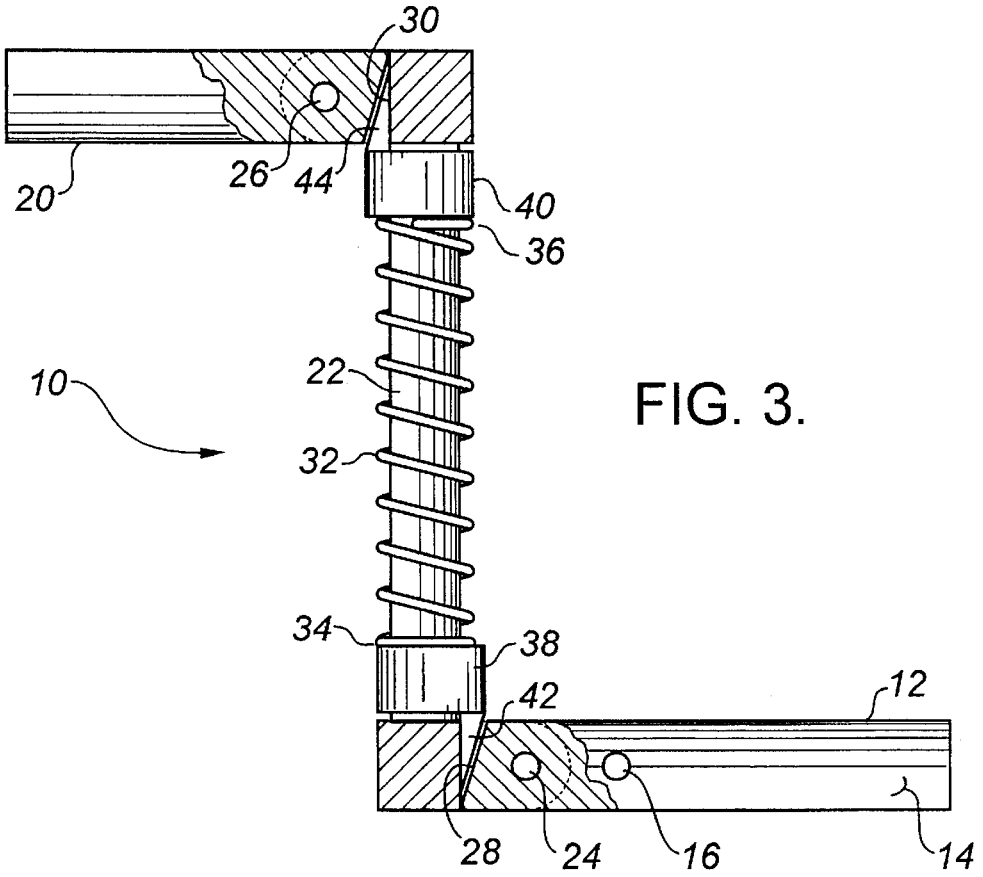
FIG. 3 is a detailed side elevation view in section of the locking mechanism of the fence repairing tool illustrated in FIG. 1.

Referring to FIG. 1, fence repairing tool 10 includes an elongate wire retaining member 12 having an exterior surface 14 and a transverse passage 16. A crank 18 is provided which has a handle 20 and a shaft 22. Wire retaining member 12 is pivotally secured to shaft 22 at pivotal connection 24. Wire retaining member 12 is pivotally movable between a stored position and an operative position. In the stored position wire retaining member 12 is positioned substantially parallel to shaft 22, as illustrated in FIG. 2. In an operative position wire retaining member 12 is positioned substantially perpendicular to shaft 22, as illustrated in FIG. 1. In the operative position wire retaining member 12 is rotated by manipulating handle 20 of crank 18. Handle 20 of crank 18 is pivotally connected to shaft 22 at pivotal connection 26 and is pivotally movable between a stored position and an operative position. In the stored position handle 20 is positioned substantially parallel to shaft 22, as illustrated in FIG. 2. In the operative position handle 20 is positioned substantially perpendicular to shaft 22, as illustrated in FIG. 1. Referring to FIG. 3, wire retaining member 12 and handle 20 each having transverse locking apertures 28 and 30, respectively, adjacent pivotal connections 24 and 26. Referring to FIGS. 1 and 2, a biasing spring 32 is wrapped around shaft 22 of crank 18. Referring to FIG. 2, biasing spring 32 has opposed ends 34 and 36. Collars 38 and 40 are positioned at opposed ends 34 and 36, respectively. Collars 38 and 40 have locking members 42 and 44, respectively that project axially away from biasing spring 32. Referring to FIG. 3, locking member 42 extends into locking aperture 28 of wire retaining member 12 locking it in the operative position. Locking member 44 extends into locking aperture 30 of handle 20 to lock it in the operative position. When it is desired to place fence repairing tool 10 back into the stored position illustrated in FIG. 2, a force is manually exerted upon collars 38 and 40 to compress biasing spring 32 until locking members 42 and 44 are withdrawn from locking apertures 28 and 30, respectively. With locking members 42 and 44 withdrawn wire retaining member 12 and handle 20 may be pivoted about pivotal connections 24 and 26 back into the stored position.

Figure 4:
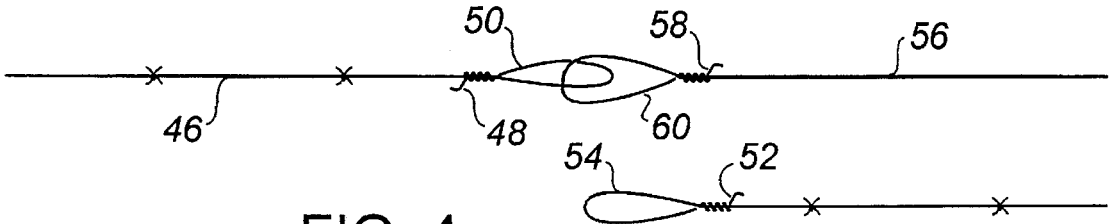
FIG. 4 is side elevation view illustrating preparatory steps in the repair wire fence.
Figure 5:
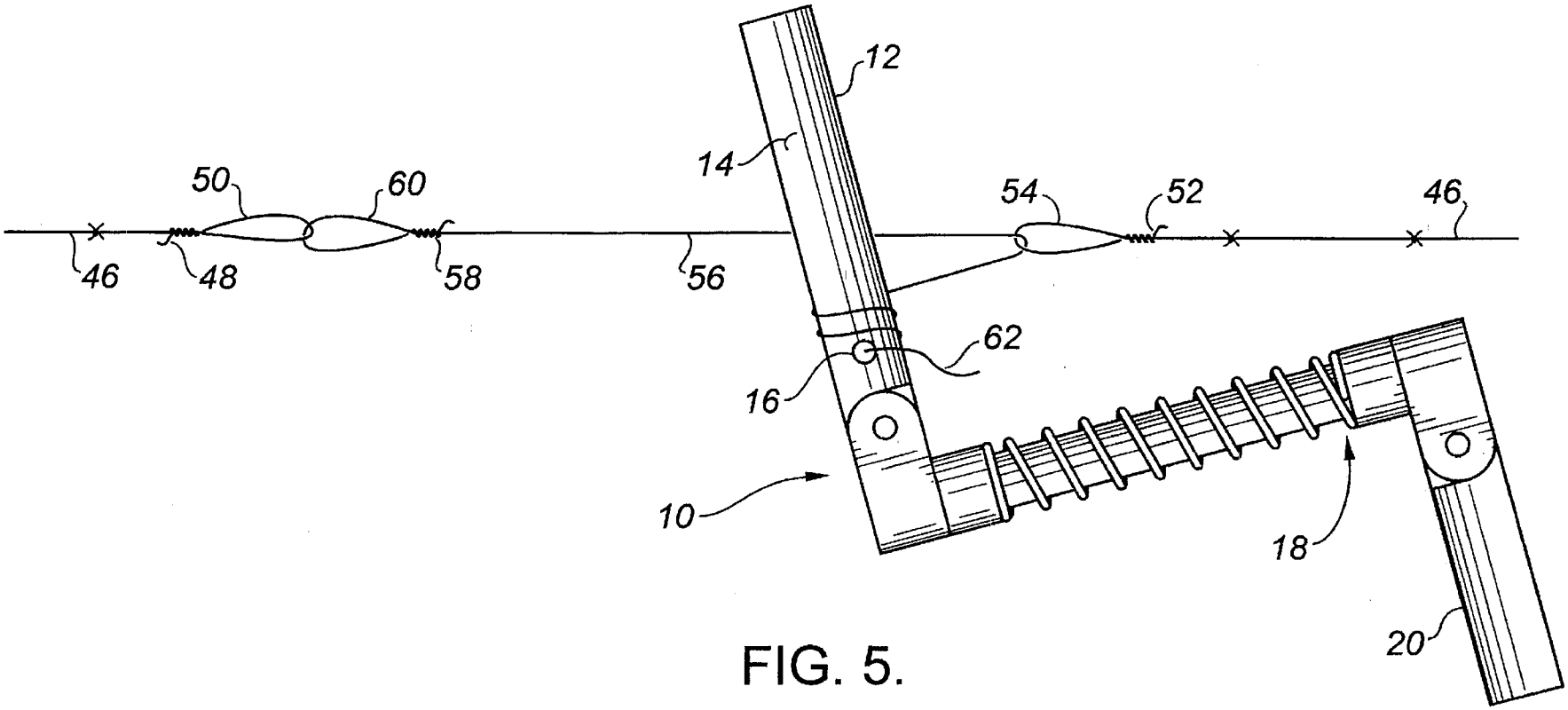
FIG. 5 is a side elevation view of the wire fence illustrated in FIG. 4 being repaired with the fence repairing tool illustrated in FIG. 1.

The use and operation of fence repairing tool 10 will now be described with reference to FIGS. 1 through 5. Referring to FIG. 4, wire 46 is prepared for use with fence repairing tool 10 by forming an end 48 into a first loop 50 and an end 52 into a second loop 54. A repair wire 56 is then interlocked with first loop 50 by forming a first end 58 of repair wire 56 into a third loop 60. A second end 62 of repair wire 56 is then threaded through second loop 54. Fence repairing tool 10 in moved from the stored position illustrated in FIG. 2 to an operative position illustrated in FIG. 1. This is accomplished by pivoting wire retaining member 12 and handle 20 to a position substantially perpendicular to shaft 22. Collars 38 and 40 are then rotated ¼ turn until locking members 42 and 44 are inserted into locking apertures 28 and 30, respectively, as illustrated in FIG. 3. Referring to FIG. 5, second end 62 of repair wire 56 is inserted into transverse passage 16 of wire retaining member 12 of fence repairing tool 10. Wire retaining member 12 is then slowly rotated by means of handle 20 of crank 18 to wrap repair wire 56 around exterior surface 14. This serves to pull end 48 and end 52 of wire 46 together. Repair wire 56 is pulled 180 degrees back onto itself by grasping handle 20 with one hand and wire retaining member 12 with the other. Simultaneously, repair wire 56 is unwound from exterior surface 14 of wire retaining member 12. Repair wire 56 will maintain its position as long as it continues to be pulled back 180 degrees. Repair wire 56 unwinds straight and parallel to itself. Once repair wire 56 is detached from fence repairing tool 10, it is manually held to ensure that it stays at 180 degrees, and then is wrapped around itself to secure end 48 and end 52 of wire 46 together. Fence repairing tool 10 is the placed back into the stored position illustrated in FIG. 2. This is accomplished by withdrawing locking members 42 and 44 from locking apertures 28 and 30, respectively. Collars 38 and 40 are then rotated ¼ turn to move locking members 42 and 44 out of alignment with locking apertures 28 and 30, respectively. Wire retaining member 12 and handle 20 can then be pivoted to the stored position substantially parallel to shaft 22.

It will be apparent to one skilled in the art that fence repairing tool 10 allows the operator to safely keep clear of wire 46 while repairs are being made. It will also be apparent to one skilled in the art that modifications may be made to the illustrated embodiment without departing from the spirit and scope of the invention as defined by the claims.

The embodiments of the invention in which an exclusive property or privilege is claimed are as follows:

1. A fence repairing tool for wire fences, comprising:

an elongate ware retaining member having an exterior surface and a transverse passage, such that an end of a wire may be inserted into the transverse passage and the wire retaining member rotated to wrap wire around the exterior surface of the wire retaining member;

a crank having a handle and a shaft having opposed ends, the wire retaining member being pivotally secured to the shaft at one of the opposed ends by a transverse pivotal connection and pivotally movable between a stored position substantially parallel to the shaft and an operative position resting against said one of the opposed ends substantially perpendicular to the shaft in which position the wire retaining member is rotated by manipulating the handle of the crank, the handle of the crank being pivotally connected the shaft at an other of the opposed ends by a transverse pivotal connection and pivotally movable between a stored position substantially parallel to the shaft and an operative position resting against said other of the opposed ends substantially perpendicular to the shaft, the wire retaining member and the handle each having a transverse locking aperture adjacent the pivotal connection with the shaft; and a biasing spring wrapped around the shaft of the crank, a collar which telescopically receives the shaft is positioned at each end of the biasing spring, each collar has a locking member projecting axially away from the biasing spring, the locking members extending into the locking apertures of the wire retaining member and the handle when they are in the operative position, thereby locking the wire retaining member and the handle in their respective operative positions.

* * * * *